US005682998A

United States Patent [19]

McCoy et al.

[11] Patent Number: 5,682,998

[45] Date of Patent: Nov. 4, 1997

[54] PACKAGING FOR A TRAILER HITCH RECEIVER

[75] Inventors: Richard McCoy, Granger, Ind.; Marvin L. Hanson, Vandalia, Mich.

[73] Assignee: Reese Products, Inc., Elkhart, Ind.

[21] Appl. No.: 607,500

[22] Filed: Feb. 27, 1996

[51] Int. Cl.[6] ..... B65D 85/64

[52] U.S. Cl. ..... 206/485; 206/592; 206/594

[58] Field of Search ..... 206/591, 592, 206/593, 594, 521, 485, 335

[56] References Cited

U.S. PATENT DOCUMENTS

| | | | |
|---|---|---|---|
| 1,381,487 | 6/1921 | Maruny et al. . | |
| 2,314,491 | 3/1943 | Greenberg . | |
| 3,015,428 | 1/1962 | Magazzu | 206/592 |
| 3,192,680 | 7/1965 | Mantell et al. | 206/592 X |
| 3,305,081 | 2/1967 | Broecker . | |
| 4,008,847 | 2/1977 | Davis | 206/335 X |
| 4,134,493 | 1/1979 | Cech . | |
| 4,706,809 | 11/1987 | Halsell . | |
| 4,865,200 | 9/1989 | Sullivan et al. | 206/594 X |
| 5,064,056 | 11/1991 | Gresh | 206/485 X |
| 5,341,931 | 8/1994 | Prochaska et al. . | |

*Primary Examiner*—Jacob K. Ackun
*Attorney, Agent, or Firm*—King and Schickli

[57] ABSTRACT

Packaging is provided for a trailer hitch receiver. The packaging includes an outer carton having four sidewalls and two endwalls and an insert received in the carton. The insert includes two pair of cooperating slots for engaging the trailer hitch receiver components. The insert is substantially rectangular in shape and engages all four sidewalls of the outer carton.

12 Claims, 4 Drawing Sheets

C
52
50
14
B
48
54
52
50
48
52
50
54
52
50
48
14
54
52
50

PACKAGING FOR A TRAILER HITCH RECEIVER

TECHNICAL FIELD

The present invention relates generally to the packaging field and, more particularly, to a cradle-like insert and carton for packaging and cushioning components of a trailer hitch receiver.

BACKGROUND OF THE INVENTION

The importance of packaging small yet relatively heavy articles to prevent shifting and possible damage thereto during shipment has long been known in the art. Examples of such packaging are, for example, disclosed in U.S. Pat. Nos. 2,314,491 to Greenburg; 3,305,081 to Broecker; and 4,706,809 to Halsell. Generally, these patents refer to corrugated cardboard containers, boxes or cartons including corrugated cardboard inserts for holding or cradling the article being packaged to prevent it from shifting during shipping and thereby prevent damage to the article.

While the general concept of packaging in this manner has been known for over 50 years, no effort has been made to apply such an approach to the heavy and unusually shaped components of a trailer hitch receiver. As is well known in the art, a trailer hitch receiver generally comprises a hitch box mounted to a crossbeam and a pair of side mounting brackets. Because of their high weight and odd shape, these components tend to shift during shipping and handling resulting in scratches or other damage to the paint finish. Further, the outer carton is often damaged during shipping. The carton may include a crumpled center section and/or damage to one or more ends of the carton. Of course, such a blemished product finish and/or even a damaged carton leaves a poor commercial impression with the purchaser/end user which should be avoided if at all possible.

SUMMARY OF THE INVENTION

Accordingly, it is a primary object of the present invention to provide packaging for a trailer hitch receiver including an outer carton and a cradle-like insert that minimize the shifting of the trailer hitch receiver components during shipping. This better insures the integrity of the carton and the protection of the components from nicks, scratches and other blemishes that might otherwise result from relative movement between the components.

An additional object of the present invention is to provide improved packaging for the components of a trailer hitch receiver including high strength end walls better capable of withstanding impact damage during shipping and handling.

Yet another object of the present invention is to provide a carton for a trailer hitch receiver including a customized insert that cradles the crossbeam of the trailer hitch receiver and simultaneously captures the side frame brackets against one sidewall of the carton so as to secure the components in position and substantially prevent relative shifting of the components during shipping.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, packaging is provided for the components of a trailer hitch receiver including a cross beam carrying a receiver box and a pair of opposed side mounting brackets. Preferably the packaging comprises an outer carton having four sidewalls and two end walls and an insert received in the carton. The insert includes a first pair of aligned slots for engaging and holding the side mounting brackets and a second pair of aligned slots for forming a cradle for engaging and holding the cross beam. The insert engages the four sidewalls of the carton so as to secure the cross beam and side mounting brackets from shifting in the carton during shipping and handling.

More preferably describing the invention, the outer carton includes a base section and a lid section. The base section has first and second sidewall panels each with opposing, hinged tongues as well as a third sidewall panel with a pair of locking slots adjacent to distal ends thereof. Further, the base section includes a first pair of opposed, doubled-over end wall panels. Each of the doubled-over end wall panels forms a first pocket for receiving one tongue of each of the first and second sidewall panels. Accordingly, a three-layer-thick end wall is provided at each end of the base section. This provides excellent structural rigidity allowing the carton to withstand rough handling without crumbling.

Preferably, the lid section includes a front sidewall panel with opposing hinged tongues and a top sidewall panel connected by a hinge to the second sidewall panel of the base section. Further, the lid section includes a second pair of opposed, doubled-over end wall panels. Each of these panels forms a second pocket for receiving one tongue of the front sidewall panel. Thus, it should be appreciated that the lid includes three-layer-thick end walls which, when the lid section is closed, overlap the three-layer-thick endwalls of the base section providing still further strength to the carton particularly when stood on end.

Preferably, the insert is substantially rectangular in shape. The insert includes a first pair of face panels for engaging two opposing sidewalls of the carton and a second pair of face panels spaced from the end walls of the carton carrying the first and second pairs of aligned slots. Each of the first pair of aligned slots is substantially 0.5 by 7.0 inches and each of the second pair of aligned slots is substantially 2.5 by 2.75 inches. Each of the second pair of aligned slots open into the first set of align slots so that the cross beam and side mounting brackets are held in a stacked orientation and are effectively surrounded and prevented from shifting by engagement with the first and second pairs of slots and the top sidewall panel of the lid section.

In accordance with yet another aspect of the present invention, a method of packaging the components of a trailer hitch receiver is provided. The method includes providing an outer carton with four sidewalls and two end walls. Additionally, the method includes positioning an insert in the carton. Further, there is the providing of a first set of aligned slots in the insert to receive and engage the side mounting brackets to hold them in position during shifting and handling. All four sidewalls of the carton are engaged with the insert so as to prevent the shifting of the insert and therefore, the trailer hitch receiver components in the carton.

Still further, the method includes the additional step of providing a second set of aligned slots in the insert. This second set of aligned slots function as a cradle to receive and engage the cross beam component of the hitch receiver. Together, the insert and carton function to prevent shifting of the components and thereby any damaging and marring of the surface finish of the components.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
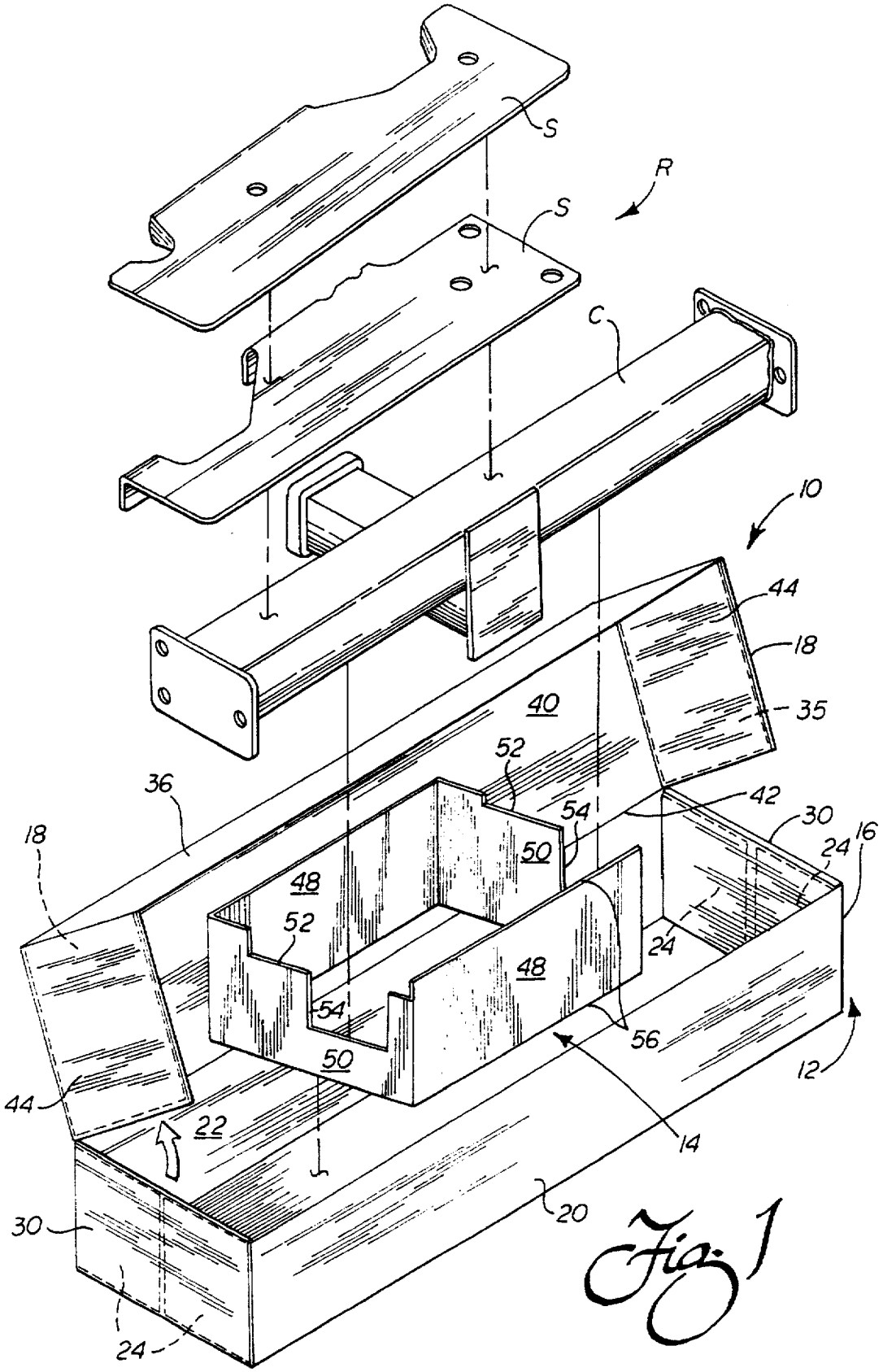
FIG. 1 is an exploded perspective view showing the packaging of the present invention including the outer carton and insert.

Reference is now made to FIG. 1 showing the packaging 10 of the present invention specifically adapted for receiving and holding the components of a trailer hitch receiver R. The components are shown as a cross beam C and a pair of side mounting brackets S. As best shown in FIG. 1, the packaging 10 comprises an outer carton and an insert generally designated by reference numerals 12, 14, respectively.

More specifically, the outer carton 12 includes a base section 16 and a lid section 18. The base section 16 comprises first and second sidewall panels 20, 22. Each of these panels 20, 22 includes opposed, hinged tongues 24 shown in phantom in FIG. 1. The base section 16 also includes a third sidewall panel 26 including a pair of locking slots 28 adjacent distal ends thereof (see also FIG. 6).

Figure 6:
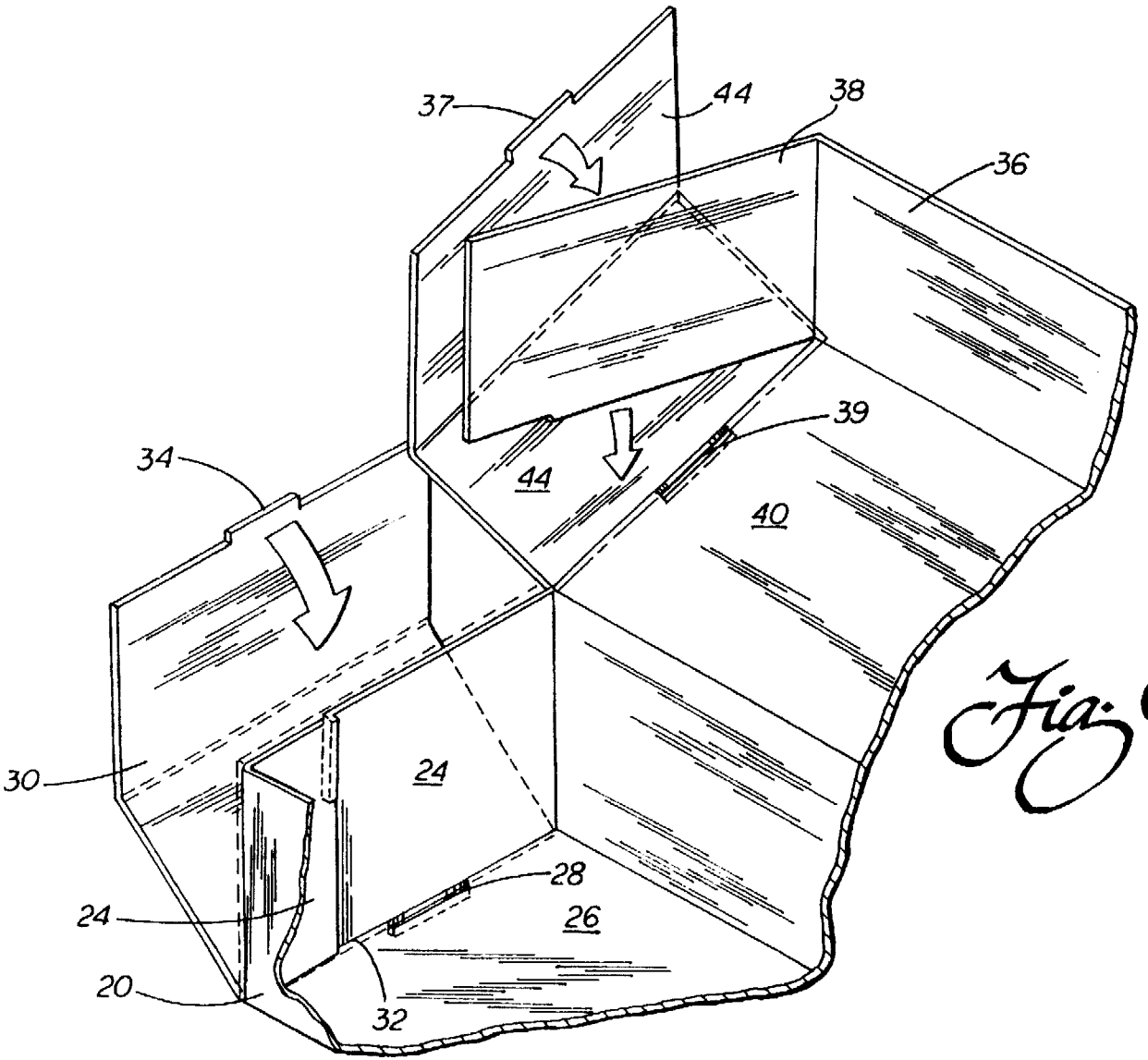
FIG. 6 is a detailed perspective view showing the end wall construction of the lid and base sections of the carton.

Further, the base section 16 includes a first pair of opposed, doubled-over end wall panels 30. As shown, one end wall panel 30 is connected by a hinge 32 to each end of the third sidewall panel 26. As best shown in FIG. 6, when doubled-over each of the end wall panels 30 forms a first pocket for receiving the tongues 24 of the first and second sidewall panels 20, 22. Locking tabs 34 provided at the distal end of each doubled-over end wall panel 30 are received in the cooperating locking slots 28 in the third sidewall panel 26 in order to secure the end wall panels 30 in proper position (again note particularly, FIG. 6).

The lid section 18 preferably includes a front sidewall panel 36 having opposed, hinged tongues 38. The tongues 38 are shown in phantom in FIG. 1. The lid section 18 also includes a top sidewall panel 40 connected by a hinge 42 to the second sidewall panel 22 of the base section 16. A second pair of opposed, doubled-over end wall panels 44 are hinged to the top sidewall panel 40. Each of the opposed, doubled-over end wall panels 44 forms a second pocket for receiving and holding the tongues 38 of the front sidewall panel 36 (note particularly the detail in FIG. 6). If desired, the end wall panels 44 may be secured in the doubled-over position in the same manner as the end wall panels 30 by providing cooperating tabs 37 on the panels 44 and slots 39 in or on the top sidewall panel 40.

Advantageously, the resulting carton structure includes base and lid sections 16, 18 both with triple layered end walls for added strength and rigidity. Such end walls are capable of withstanding crumpling and maintaining structural integrity, even when subjected to rough handling. This is true despite the relatively high weight of the trailer hitch receiver components including the cross beam C and side mounting brackets S contained therein.

Figures 2, 5:
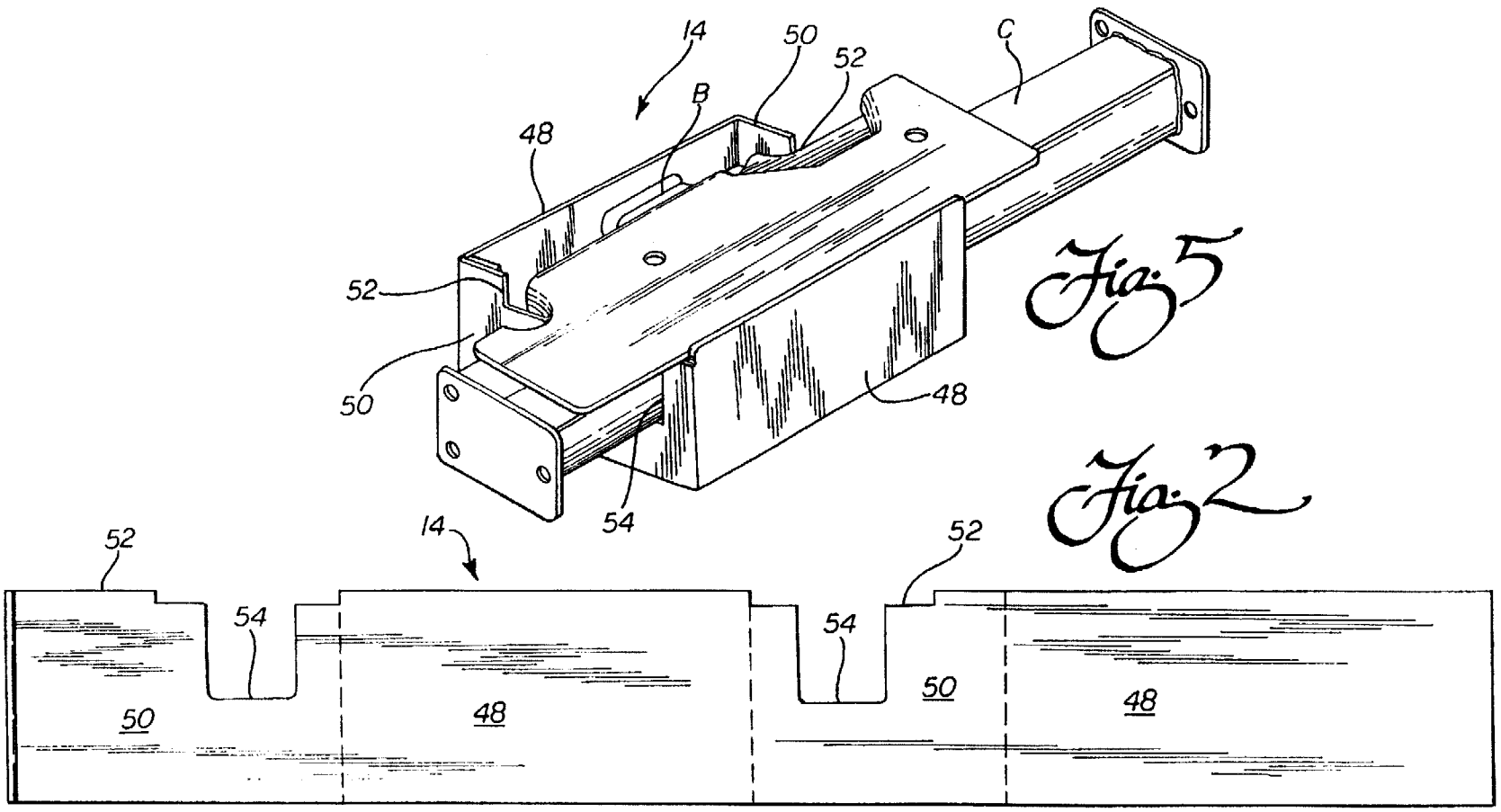
FIG. 2 is a top plan view of a panel from which the insert is constructed.
FIG. 5 shows the positioning of the second side mounting bracket on the insert.

As shown in FIG. 1, the insert 14 is preferably substantially rectangular in shape (e.g. 11.5 inches long, 9.75 inches wide and 6.0 inches tall) and includes a first pair of face panels 48 for engaging the two opposing sidewalls 20, 22 of the base section 16 of the carton 12. The insert 14 also includes a second pair of face panels 50 spaced from the end walls 30 of the carton 12. As shown, the face panels 50 carry a first set of aligned slots 52 that may, for example, be substantially 0.5 by 7.0 inches deep and long. Further, a second set of aligned slots 54 is provided in the first set of aligned slots on the panels 50. Preferably, each of the second set of aligned slots is substantially 2.5 inches in depth by 2.75 inches in width. Of course, both the outer carton 12 and insert 14 may be formed from corrugated cardboard. An individual sheet of corrugated cardboard may be utilized to form the carton. Similarly, a corrugated cardboard panel as shown in FIG. 2 may be utilized to form the insert.

Figure 3:
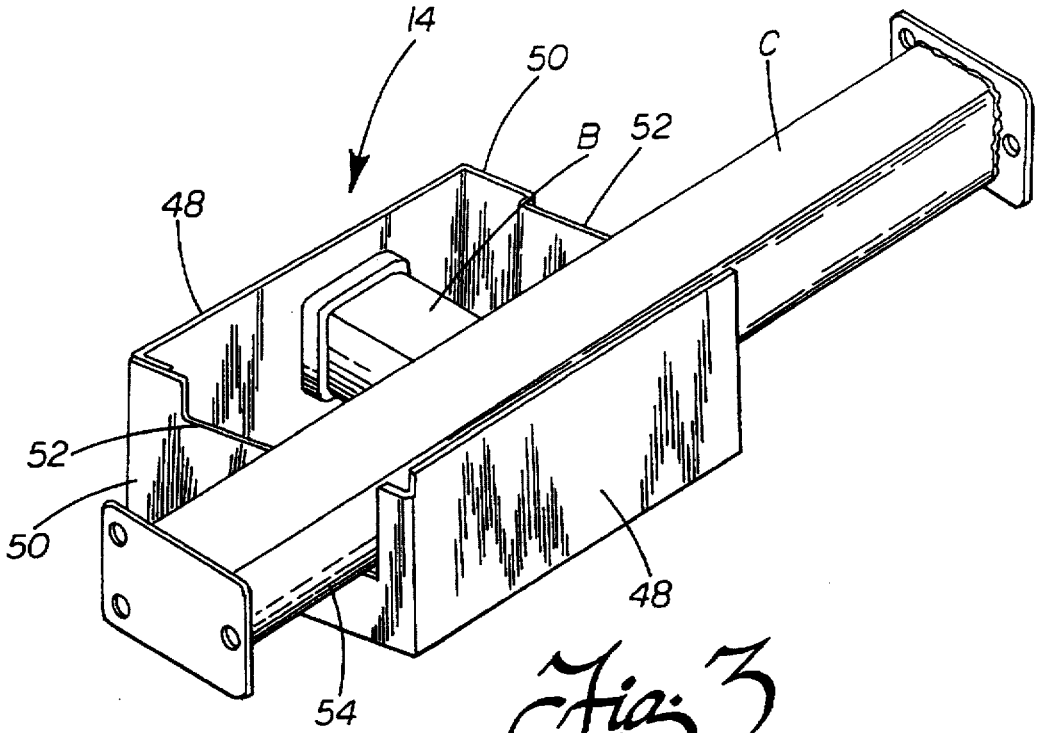
FIG. 3 is a perspective view showing the positioning of the cross beam component of the trailer hitch in the insert.

First, the outer carton 12 and insert 14 are erected from corrugated cardboard sheet material as shown in FIG. 1. Next the trailer hitch receiver R is packaged in the carton 12 by first positioning the insert 14 in a central position in the carton with the face panels 48 abutting the sidewall panels 20, 22. Once the insert 14 is properly positioned, the cross beam C is cradled in the insert so that the receiver box B is fully received and held in the insert and the main tube of the cross beam is received and securely engaged by the second set of aligned slots 54 (see FIG. 3).

Figure 4:
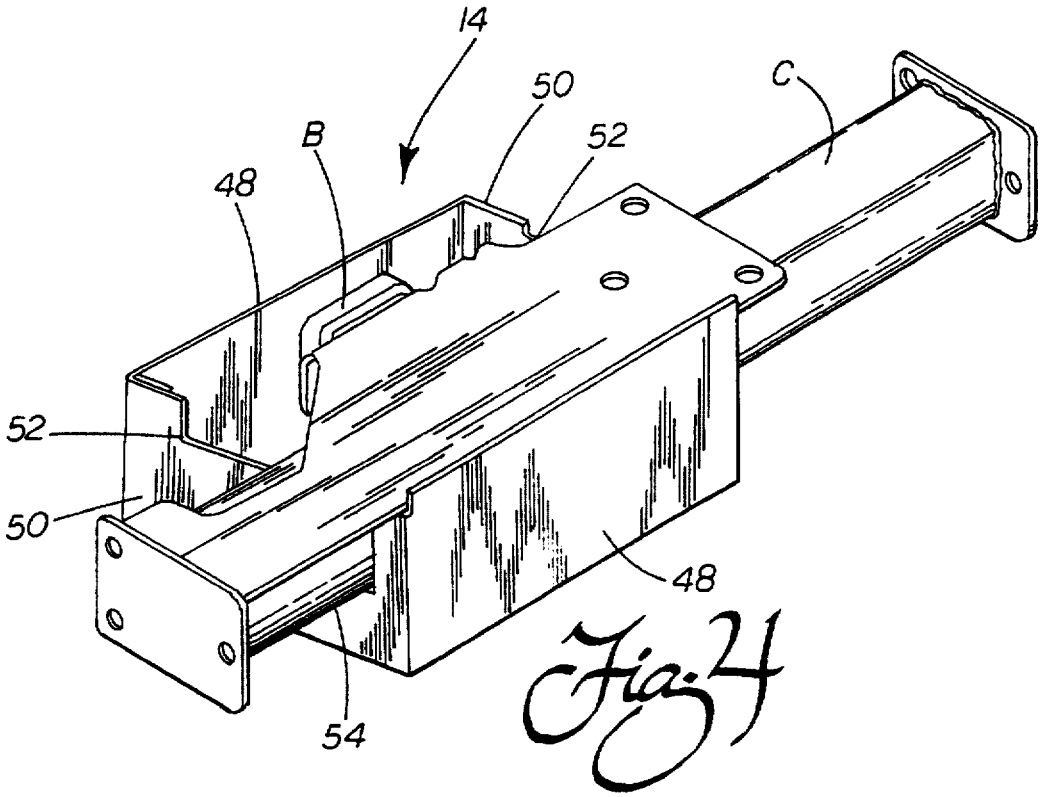
FIG. 4 is a perspective view showing the next step in the packaging process including the positioning of the first side mounting bracket in the insert.

Next, a first of the side mounting brackets S is positioned in overlapping relationship relative to the cross beam C. As shown in FIG. 4, the side mounting bracket S rests partially upon the cross beam C while being received in the first set of aligned slots 52. Thus, it should be appreciated that the side mounting bracket S also rests partially upon the cooperating shoulders formed by the slots 52 in the face panels 50. Next, as shown in FIG. 5, the second side mounting bracket S is positioned in the slots 52 overlapping the first side mounting bracket. When the lid section 18 is closed on the base section 16 and secured by staples, reinforced packing tape or other fastening means, the upper and lower edges 56 of the first and second insert face panels 48, 50 engage the third sidewall panel 26 of the base section 16 and the top sidewall panel 40 of the lid section 18. Of course, as already described, the face panels 48 butt against the sidewall panels 20, 22. Further, the mounting brackets M at the ends of the cross beams C butt up against the end wall panels 30. This "full spanning" of the carton 12 between the end wall panels 30 by the cross beam C prevents unnecessary shifting of the components along the longitudinal axis of the carton and further increases the strength and rigidity of the end walls 30. Further, the resulting "all-side" engagement of the insert 14 with the carton 12 and the sandwiching of the components S, C between the insert and sidewall 40 prevents any other shifting.

In summary, numerous benefits result from employing the concepts of the present invention. The insert 14 includes first and second sets of cooperating slots 52, 54 that cradle and hold the trailer hitch receiver components. The end walls are effectively formed from two overlapping triple layered end panels 30, 44 for added structural strength and rigidity. The cross beam C spans the longitudinal axis between the end walls and includes mounting brackets M butting up against the end walls. This further supports the structural integrity of the end walls (i.e. the cross beam and mounting brackets function as end wall bolsters) and also prevents any shifting along the longitudinal axis of the carton. Hence, the trailer hitch receiver components are held in position and prevented from shifting even during rough handling.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. Packaging for a trailer hitch receiver including a cross beam carrying a receiver box and a pair of opposed side mounting brackets, said packaging comprising;

an outer carton having four sidewalls and two end walls; and an insert received in said carton, said insert including a first set of aligned slots for engaging and holding said side mounting brackets, and a second set of aligned slots for forming a cradle for engaging and holding said cross beam, said insert engaging all four sidewalls of said carton so as to secure said cross beam and side mounting brackets against shifting in said carton;

said packaging being further characterized by:

said outer carton including a base section and a lid section; said base section including first and second sidewall panels each with opposing, hinged tongues, a third sidewall panel with a pair of locking slots adjacent distal ends thereof and a first pair of opposed doubled-over end wall panels hinged to said third sidewall panel, each of said first pair of end wall panels forming a first pocket for receiving one tongue of each of said first and second sidewall panels; and said lid section including a front sidewall panel with opposed hinged tongues, a top sidewall panel connected by a hinge to said second sidewall panel of said base section and a second pair of opposed doubled-over end wall panels hinged to said top sidewall panel each of said second pair of end wall panels forming a second pocket for receiving one tongue of said front sidewall panel.

2. The packaging for a trailer hitch receiver set forth in claim 1, wherein each of said first pair of doubled-over end wall panels includes a locking tab for engaging in one of said pair of locking slots in said third sidewall panel.

3. The packaging for a trailer hitch receiver set forth in claim 2, wherein said insert is substantially rectangular in shape having a first pair of face panels engaging two opposing sidewalls of said carton and a second pair of face panels spaced from said endwalls of said carton carrying said first and second set of slots.

4. The packaging for a trailer hitch receiver set forth in claim 3, wherein each of said first set of aligned slots is substantially 0.5" by 7.0" and each of said second set of aligned slots is substantially 2.5" by 2.75".

5. The packaging for a trailer hitch receiver set forth in claim 4, wherein said second set of aligned slots open into said first set of aligned slots.

6. The packaging for a trailer hitch receiver set forth in claim 5, wherein said rectangular insert is substantially 11.5" by 9.75" by 6".

7. The packaging for a trailer hitch receiver set forth in claim 6, wherein said insert is constructed from a single panel of corrugated cardboard.

8. The packaging for a trailer hitch receiver set forth in claim 1, wherein said insert is substantially rectangular in shape having a first pair of face panels engaging two opposing sidewalls of said carton and a second pair of face panels spaced from said endwalls of said carton carrying said first and second set of slots.

9. The packaging for a trailer hitch receiver set forth in claim 8, wherein each of said first set of aligned slots is substantially 0.5" by 7.0" and each of said second set of aligned slots is substantially 2.5" by 2.75".

10. The packaging for a trailer hitch receiver set forth in claim 9, wherein said second set of aligned slots open into said first set of aligned slots.

11. The packaging for a trailer hitch receiver set forth in claim 10, wherein said rectangular insert is substantially 11.5" by 9.75" by 6".

12. The packaging for a trailer hitch receiver set forth in claim 11, wherein said insert is constructed from a single panel of corrugated cardboard.

* * * * *